US010168115B1

(12) United States Patent
Oglesby

(10) Patent No.: US 10,168,115 B1
(45) Date of Patent: Jan. 1, 2019

(54) MATING BOLT CARRIER AND BARREL EXTENSION

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 0 days.

(21) Appl. No.: 15/643,748

(22) Filed: Jul. 7, 2017

Related U.S. Application Data

(60) Provisional application No. 62/363,251, filed on Jul. 16, 2016.

(51) Int. Cl.
*F41A 5/26* (2006.01)
*F41A 3/68* (2006.01)

(52) U.S. Cl.
CPC . *F41A 5/26* (2013.01); *F41A 3/68* (2013.01)

(58) Field of Classification Search
CPC ..... F41A 5/26; F41A 3/64; F41A 3/68
See application file for complete search history.

(56) References Cited

U.S. PATENT DOCUMENTS

| | | | | |
|---|---|---|---|---|
| 6,116,137 | A * | 9/2000 | Strahan | F41A 3/64 42/7 |
| 9,448,020 | B1 * | 9/2016 | Olson | F41A 3/66 |
| 9,658,011 | B2 * | 5/2017 | Gomez | F41A 15/14 |
| 2012/0152104 | A1 * | 6/2012 | Audibert | F41A 5/24 89/191.01 |
| 2012/0216439 | A1 * | 8/2012 | Barrett | F41A 3/26 42/75.02 |

* cited by examiner

*Primary Examiner* — Stephen Johnson
(74) *Attorney, Agent, or Firm* — Shaddock Law Group, PC

(57) ABSTRACT

A mating bolt carrier and barrel extension, including at least some of a bolt carrier having a front face that includes one or more surface preparations or features formed at least partially thereon or therein; and a barrel extension having a rear face that includes one or more surface preparations or features formed at least partially thereon or therein, wherein at least a portion of the one or more surface preparations or features are capable of mating or interlocking with the surface preparations or features of the front face of the bolt carrier.

20 Claims, 8 Drawing Sheets

MATING BOLT CARRIER AND BARREL EXTENSION

CROSS-REFERENCE TO RELATED APPLICATIONS

This patent application claims the benefit of U.S. Patent Application Ser. No. 62/363,251, filed Jul. 16, 2016, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of firearm components. More specifically, the present disclosure relates to a mating bolt carrier and barrel extension adaptable to be used with a firearm.

2. Description of Related Art

A number of firearms operate based on a gas blowback system. One such firearm is the M-16, M-4, and AR-15 family of firearms. The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

During normal operation of a semiautomatic AR-15 style rifle, when a round is fired, gas from the burning propellant forces the bullet through the barrel. Before the bullet leaves the barrel, a portion of the gas enters a gas port in the upper part of the barrel under the front sight (or gas block). The gas port directs gas through a portion of the front sight (or gas block) and into the gas tube, which directs the gas into a cylindrical gas aperture 42 of the bolt carrier gas key 40, between the bolt carrier 20 and the bolt 50 and drives the bolt carrier 20 rearward.

The buffer, which is pushing on the rear of the bolt carrier group 10, is forced rearward by the bolt carrier group 10 compressing the recoil spring. During this rearward movement, a cam pin track or slot 22 in the upper portion of the bolt carrier 20 acts on the bolt cam pin 30, translating the rearward linear movement of the carrier into rotational movement, thereby rotating the cam pin 30 and bolt 50 clockwise so that the bolt locking lugs are unlocked from the barrel extension locking lugs. As the rearward movement of the bolt carrier group 10 continues, the empty cartridge case is extracted from the chamber, and ejected through the ejection port.

As the bolt carrier group 10 clears the top of an inserted magazine and the empty cartridge case is expelled, a new round is pushed into the path of the bolt 50 by the upward thrust of the magazine follower and spring.

As the bolt carrier group 10 continues to move rearward, it overrides the hammer and forces the hammer down into the receiver, compressing the hammer spring, and allowing the rear hook of the hammer to engage with the hammer disconnect.

When the bolt carrier group 10 reaches its rearmost position (when the rear of the buffer contacts the rear of the buffer tube), the compressed recoil spring expands, driving the buffer assembly forward with enough force to drive the bolt carrier group 10 forward, toward the chamber, initiating chambering of the waiting round from the magazine into the chamber.

The forward movement of the bolt 50 ceases when the locking lugs pass between the barrel extension locking lugs and the round is fully chambered. When the bolt carrier 20 enters the final portion of its forward movement, the bolt cam pin 30 emerges from the cam pin guide channel in the upper receiver and moves along the cam pin slot 22, rotating the bolt 50 counterclockwise. This rotation locks the bolt 50 to the barrel extension (by interaction of the bolt locking lugs and the barrel extension locking lugs). The locking of the bolt 50 completes the cycle of operation and, when the trigger is released, the rear hammer hook hammer slips from the disconnect and the front hammer hook is caught by the sear of the trigger. The firearm is then ready to be fired again.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, the typical bolt carrier arrangement has various shortcomings. For example, because the front surface of the bolt carrier and the rear surface of the barrel extension provide strictly planar, parallel surfaces, as the firing cycle occurs, when the two parallel surfaces of the bolt carrier and the barrel extension (the strictly planar front surface of the bolt carrier and the strictly planar rear surface of the barrel extension) strike each other, the bolt carrier 20 can contact the barrel extension and then bounce backward after hitting the barrel extension, resulting in a situation known as bolt carrier bounce. The occurrence of bolt carrier bounce can be exacerbated when the bolt carrier or buffer is of a lighter weight or when the buffer spring is of a reduced strength.

Fully automatic fire is limited when bolt carrier bounce is present, because the bolt carrier bounces back from the barrel extension as the hammer falls and a lite strike results, which stops the firing sequence.

Known bolt carriers also experience a level of rotational movement during portions of the firing cycle, due to the width of the bolt carrier gas key 40 in the charging handle slot. Rounds in the magazine urge the bolt carrier from left to right as the rounds feed, potentially causing point of impact shifts in shot groupings.

In various exemplary, non-limiting embodiments, the mating bolt carrier and barrel extension of the present disclosure reduces or eliminates various shortcomings of known bolt carriers and bolt carrier groups.

In various exemplary, non-limiting embodiments, the mating bolt carrier and barrel extension of the present disclosure comprises a bolt carrier having a front face that includes one or more surface preparations or features formed at least partially thereon or therein. Similar mating or interlocking surface preparations or features are formed at least partially on or in a rear face of the barrel extension. Thus, in various exemplary, nonlimiting embodiments, as the front surface of the bolt carrier contacts the rear face of the barrel extension, the mating or interlocking surface preparations or features initially assist in guiding the bolt carrier in a desired alignment with the barrel extension.

In certain exemplary embodiments, as the front surface of the bolt carrier continues to contact the rear face of the barrel extension, the mating or interlocking surface preparations or features assist in maintaining the bolt carrier in a desired alignment with the barrel extension.

Based on the size and shape of the mating or interlocking surface preparations or features, the surface preparations or features can assist in maintaining the bolt carrier in one or more of a desired rotational alignment, horizontal alignment, and/or vertical alignment relative to the barrel extension.

Additionally, in various exemplary embodiments, the mating or interlocking surface preparations or features provide at least a partially non-planar portion to the front face of the bolt carrier and the rear face of the barrel extension.

In various exemplary, non-limiting embodiments, the mating bolt carrier and barrel extension of the present disclosure comprises at least some of a bolt carrier having a front face that includes one or more surface preparations or features formed at least partially thereon or therein; and a barrel extension having a rear face that includes one or more surface preparations or features formed at least partially thereon or therein, wherein at least a portion of the one or more surface preparations or features of the barrel extension are capable of mating with the surface preparations or features of the front face of the bolt carrier.

In various exemplary, nonlimiting embodiments, the one or more surface preparations or features formed at least partially on or in the front face of the bolt carrier comprise interlocking recesses and projections.

In various exemplary, nonlimiting embodiments, the one or more surface preparations or features formed at least partially on or in the front face of the bolt carrier comprise interlocking angled recesses and angled projections.

In various exemplary, nonlimiting embodiments, the one or more surface preparations or features formed at least partially on or in the front face of the bolt carrier comprise interlocking curved recesses and curved projections.

In various exemplary, nonlimiting embodiments, the one or more surface preparations or features formed at least partially on or in the rear face of the barrel extension are mateable with the one or more surface preparations or features formed at least partially on or in the front face of the bolt carrier.

In various exemplary, non-limiting embodiments, the mating bolt carrier and barrel extension of the present disclosure comprises at least some of a bolt carrier extending to a front face and having a bolt receiving aperture formed through at least a portion of the bolt carrier, the front face of the bolt carrier having one or more recesses and projections; and a barrel extension extending from a rear face, the rear face of the barrel extension having one or more recesses and projections, wherein at least a portion of each surface of the one or more recesses and projections of the rear face of the barrel extension is mateable with at least a portion of each surface of the one or more recesses and projections of the front face of the bolt carrier.

In various exemplary, nonlimiting embodiments, the recesses and projections of the front face of the bolt carrier are angled recesses and angled projections that form one or more substantially "V" or "W" recesses and projections in the front face.

In various exemplary, nonlimiting embodiments, at least a portion of each surface of the one or more recesses and projections of the rear face of the barrel extension correspond to and are mateable with at least a portion of each surface of the one or more recesses and projections of the front face of the bolt carrier.

In various exemplary, nonlimiting embodiments, at least a portion of each mateable surface of the one or more recesses and projections of the rear face of the barrel extension is parallel to a corresponding, mateable portion of each surface of the one or more recesses and projections of the front face of the bolt carrier.

In various exemplary, nonlimiting embodiments, adjacent surfaces that form the recesses and projections are formed at an angle that is greater than 90° relative to one another.

In various exemplary, nonlimiting embodiments, adjacent surfaces that form the recesses and projections are formed at an angle that is less than 90° relative to one another.

In various exemplary, nonlimiting embodiments, the recesses and projections of the front face of the bolt carrier are curved recesses and curved projections that form one or more substantially "U" shaped recesses and projections in the front face.

In various exemplary, nonlimiting embodiments, the recesses and projections traverse at least a portion of the front face of the bolt carrier.

In various exemplary, nonlimiting embodiments, the recesses and projections traverse the front face of the bolt carrier.

In various exemplary, non-limiting embodiments, the mating bolt carrier and barrel extension of the present disclosure comprises at least some of a bolt carrier extending to a front face, the front face of the bolt carrier having one or more recesses and projections; and a barrel extension extending from a rear face, the rear face of the barrel extension having one or more recesses and projections, wherein at least a portion of each surface of the one or more recesses and projections of the rear face of the barrel extension is mateable with at least a portion of each surface of the one or more recesses and projections of the front face of the bolt carrier.

Accordingly, the present disclosure provides a bolt carrier and barrel extension that separately and optionally provide mating surfaces that allow energy to be dispersed in a manner that reduces or eliminates bolt carrier bounce.

The present disclosure separately and optionally provides a bolt carrier and barrel extension that reduce or eliminate bolt carrier bounce.

The present disclosure separately and optionally provides a bolt carrier and barrel extension that interact or interlock to assist in locking the bolt carrier relative to the barrel extension so that there is little or no relative rotation when in battery.

The present disclosure separately and optionally provides a bolt carrier and barrel extension that can allow for an increased rate of fully automatic fire.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the present disclosure discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary and may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of this disclosure will be described in detail, with reference to the following figures, wherein like reference numerals refer to like parts throughout the several views, and wherein.

DETAILED DESCRIPTION OF THE PRESENT DISCLOSURE

Figure 1:
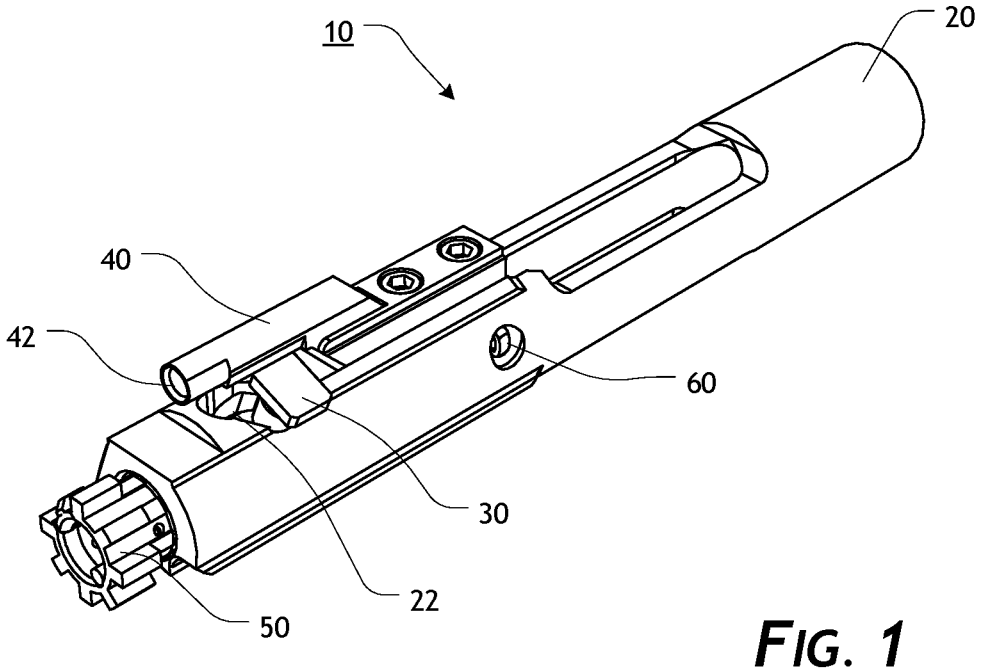
FIG. 1 PRIOR ART
FIG. 1 illustrates an upper, left, front perspective view of a known bolt carrier group.

For simplicity and clarification, the design factors and operating principles of the bolt carrier and barrel extension disclosed herein are explained with reference to various exemplary embodiments of a bolt carrier and barrel extension according to this disclosure. The basic explanation of the design factors and operating principles of the bolt carrier and barrel extension is applicable for the understanding, design, and operation of the bolt carrier and barrel extension of this disclosure. It should be appreciated that the bolt carrier and barrel extension can be adapted to many applications where a bolt carrier and barrel extension can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "bolt carrier", "barrel extension", and "firearm" are used for basic explanation and understanding of the operation of the systems, methods, and apparatuses of this disclosure. Therefore, the terms "bolt carrier", "barrel extension", and "firearm" are not to be construed as limiting the systems, methods, and apparatuses of this disclosure.

For simplicity and clarification, the bolt carrier and barrel extension of this disclosure will be described as being used in conjunction with a firearm, such as a rifle or carbine. However, it should be appreciated that these are merely exemplary embodiments of the bolt carrier and barrel extension and are not to be construed as limiting this disclosure. Thus, the bolt carrier and barrel extension of this disclosure may be utilized in conjunction with any firearm.

Turning now to the drawing FIGS., FIGS. 4-10 illustrate certain elements and/or aspects of an exemplary embodiment of the bolt carrier 100 and barrel extension 190, as disclosed herein, while FIGS. 11-17 illustrate certain elements and/or aspects of an exemplary embodiment of the bolt carrier 200 and barrel extension 290, as disclosed herein.

In illustrative, non-limiting embodiment(s) of this disclosure, as illustrated in FIGS. 4-10, the bolt carrier 100 comprises an elongate bolt carrier 100 extending from a first end to a second end.

Figure 2:
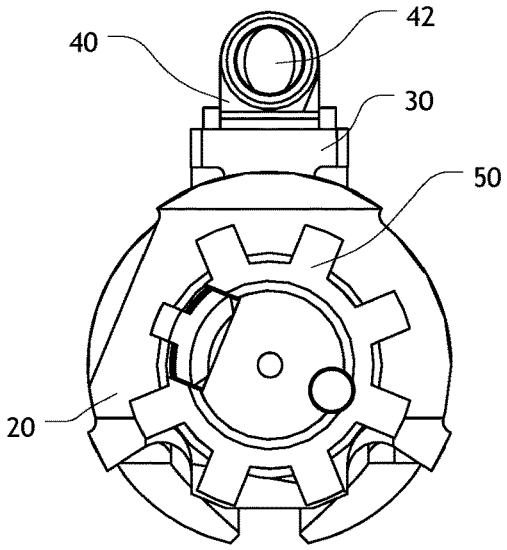
FIG. 2 PRIOR ART
FIG. 2 illustrates a front view of a known bolt carrier group in an unlocked position.
Figure 3:
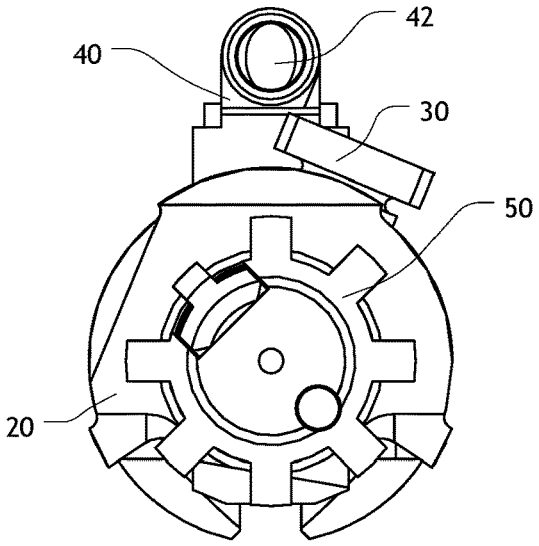
FIG. 3 PRIOR ART
FIG. 3 illustrates a front view of a known bolt carrier group in a locked position.
Figure 4:
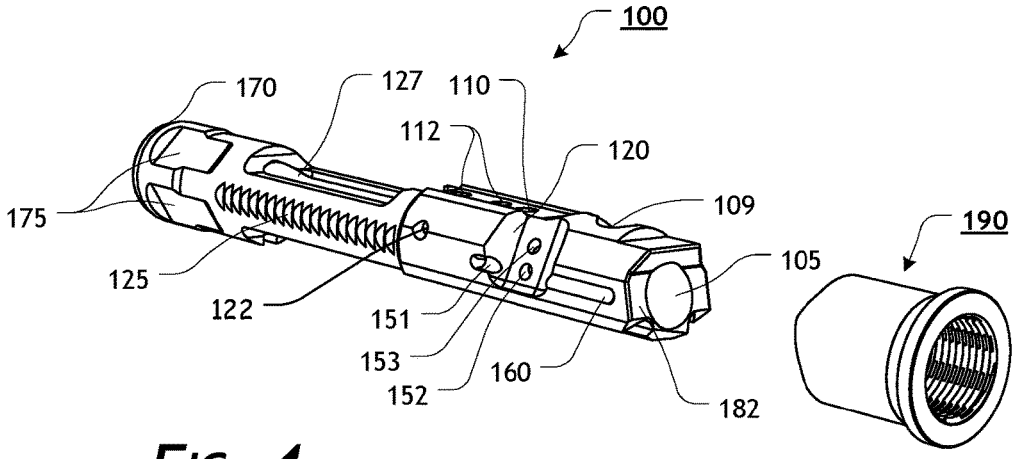
FIG. 4 illustrates an upper, right, front perspective view of an exemplary embodiment of a bolt carrier and barrel extension, as disclosed herein.
Figure 5:
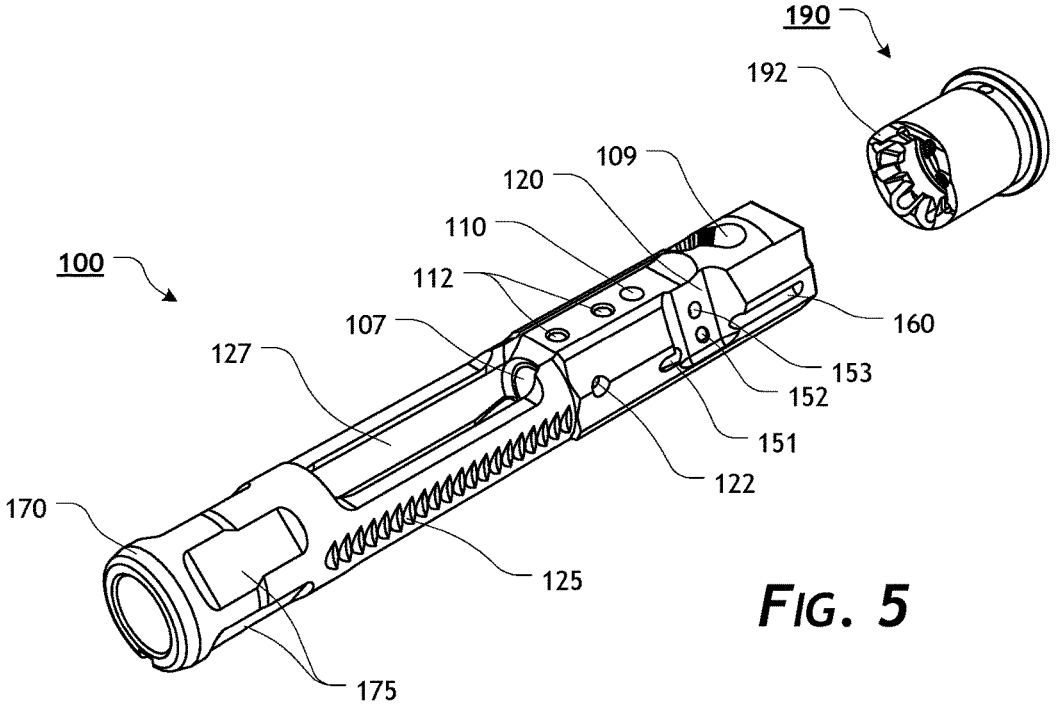
FIG. 5 illustrates an upper, right, rear perspective view of an exemplary embodiment of a bolt carrier and barrel extension, as disclosed herein.
Figure 6:
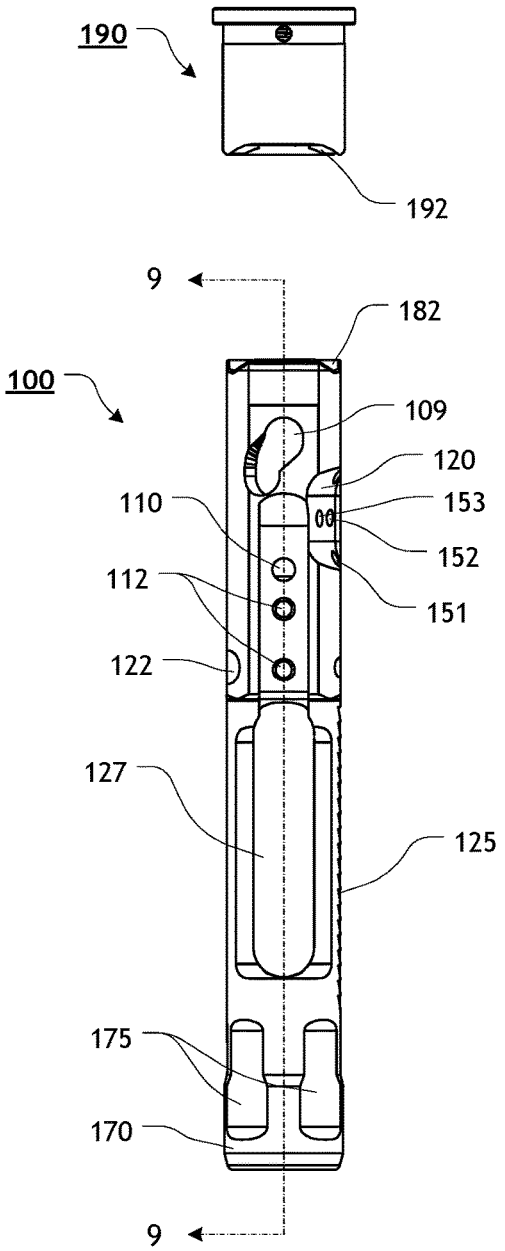
FIG. 6 illustrates a top view of an exemplary embodiment of a bolt carrier and barrel extension, as disclosed herein.
Figure 7:
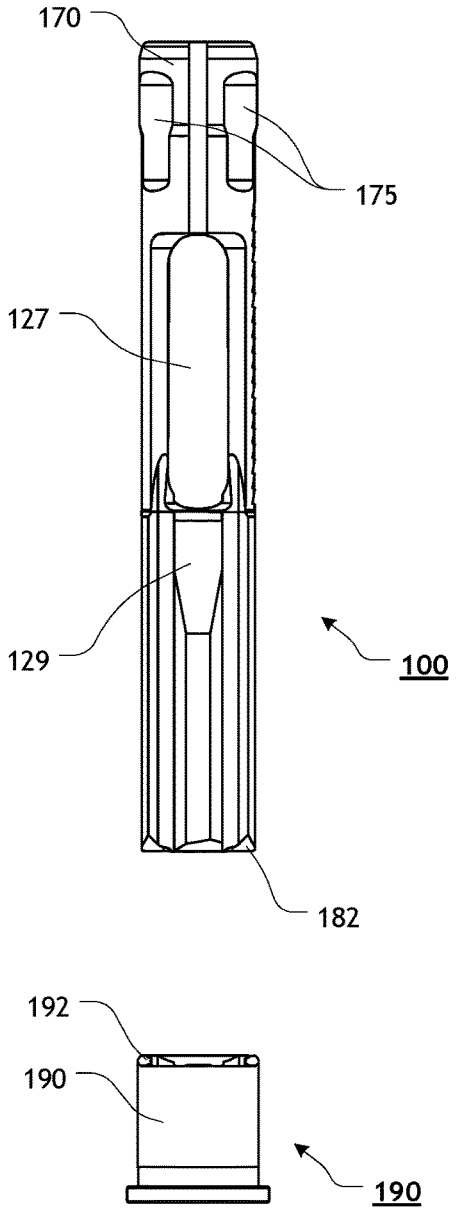
FIG. 7 illustrates a bottom view of an exemplary embodiment of a bolt carrier and barrel extension, as disclosed herein.
Figure 8:
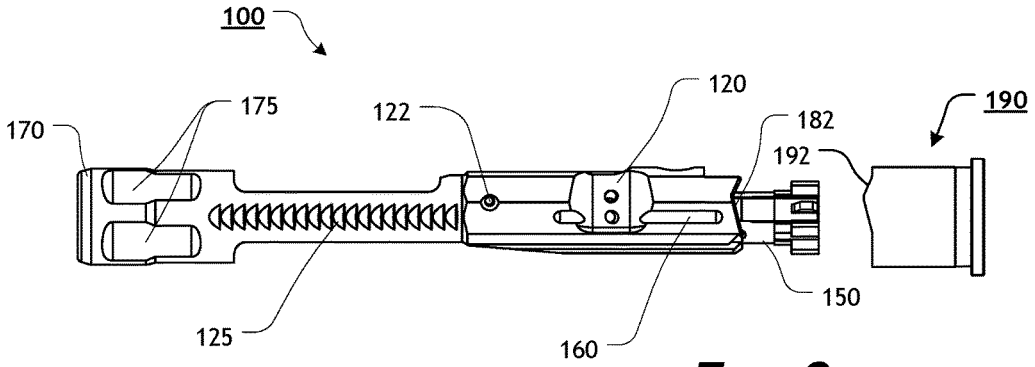
FIG. 8 illustrates a right side view of an exemplary embodiment of a bolt carrier and barrel extension, as disclosed herein.
Figure 9:
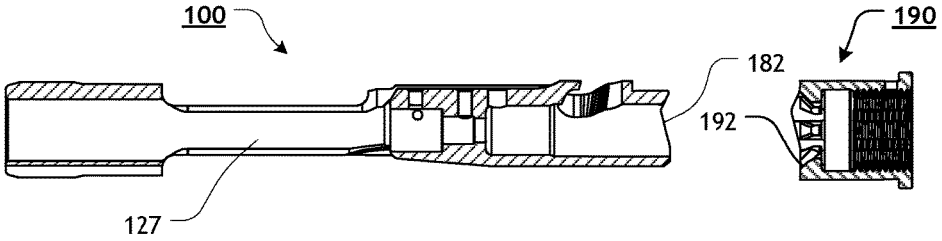
FIG. 9 illustrates a right side cross-sectional view taken along line 9-9 of the bolt carrier of FIG. 6, illustrating an exemplary embodiment of a bolt carrier and barrel extension, as disclosed herein.
Figure 10:
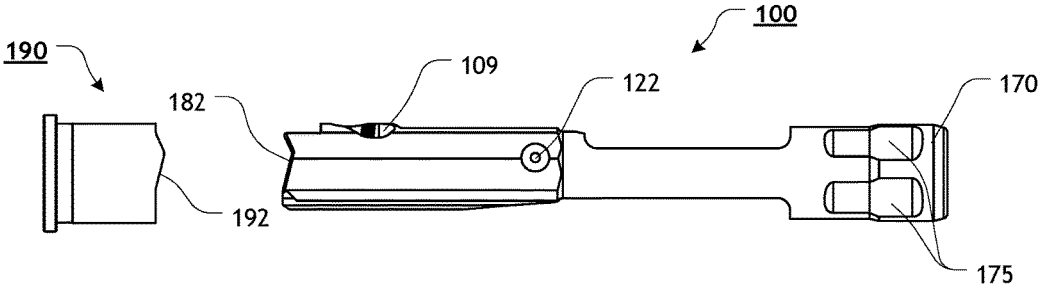
FIG. 10 illustrates a left side view of an exemplary embodiment of a bolt carrier and barrel extension, as disclosed herein.
Figure 11:
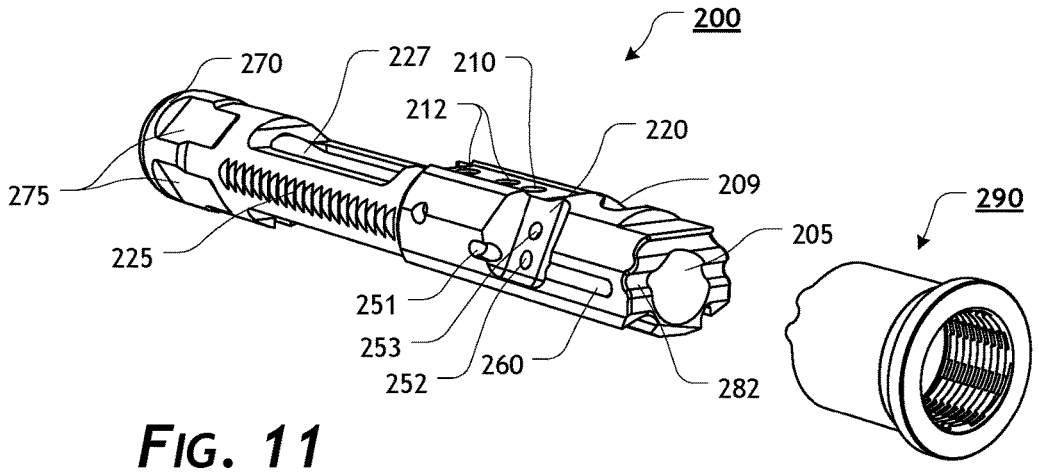
FIG. 11 illustrates an upper, right, front perspective view of an exemplary embodiment of a bolt carrier and barrel extension, as disclosed herein.
Figure 12:
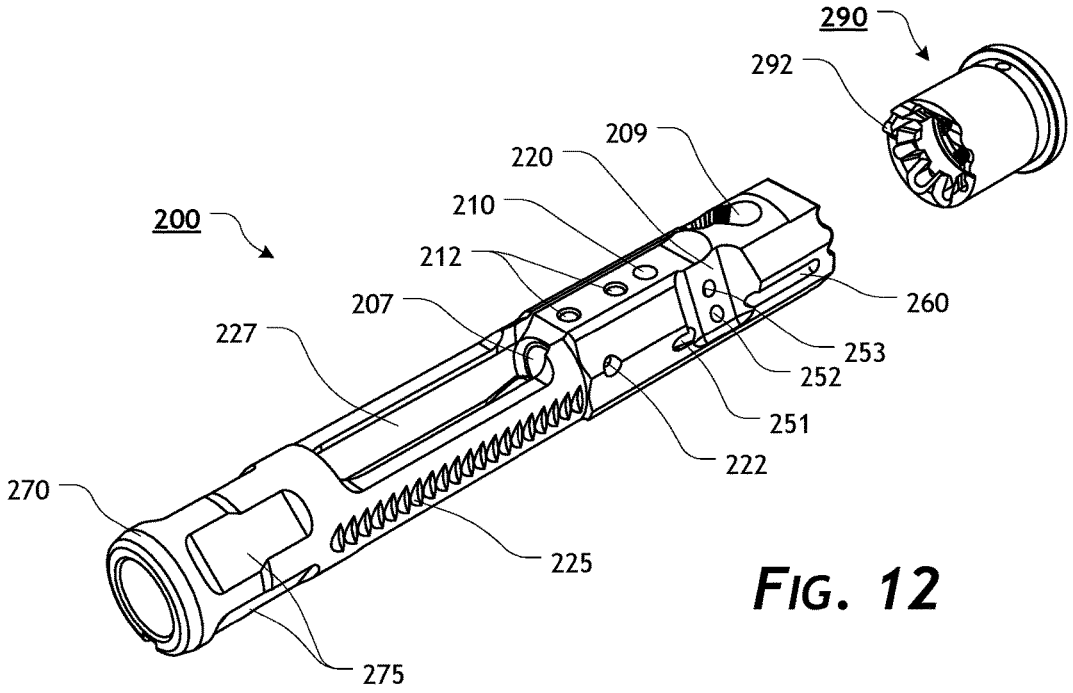
FIG. 12 illustrates an upper, right, rear perspective view of an exemplary embodiment of a bolt carrier and barrel extension, as disclosed herein.
Figure 13:
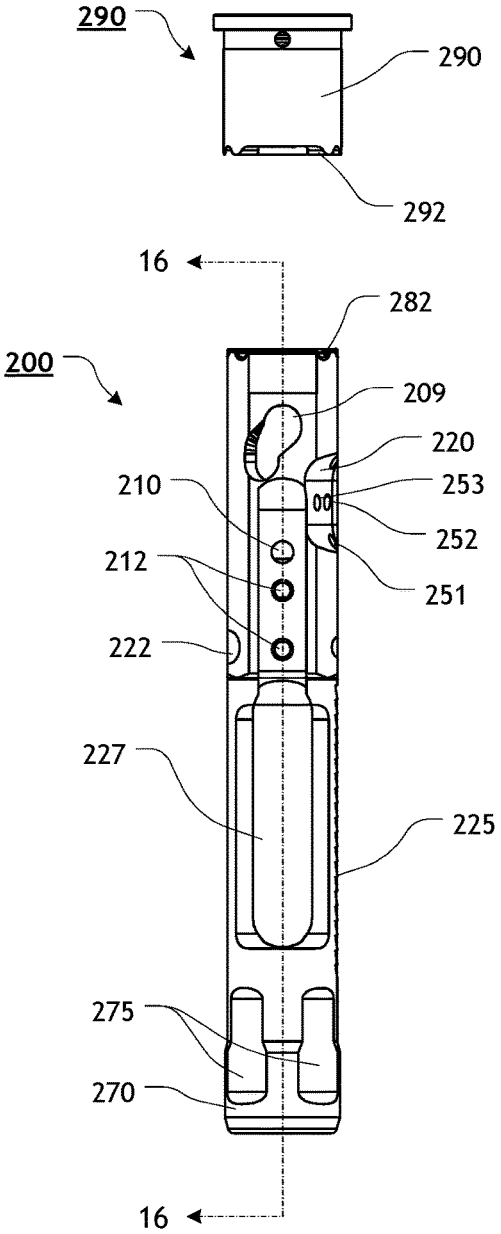
FIG. 13 illustrates a top view of an exemplary embodiment of a bolt carrier and barrel extension, as disclosed herein.
Figure 14:
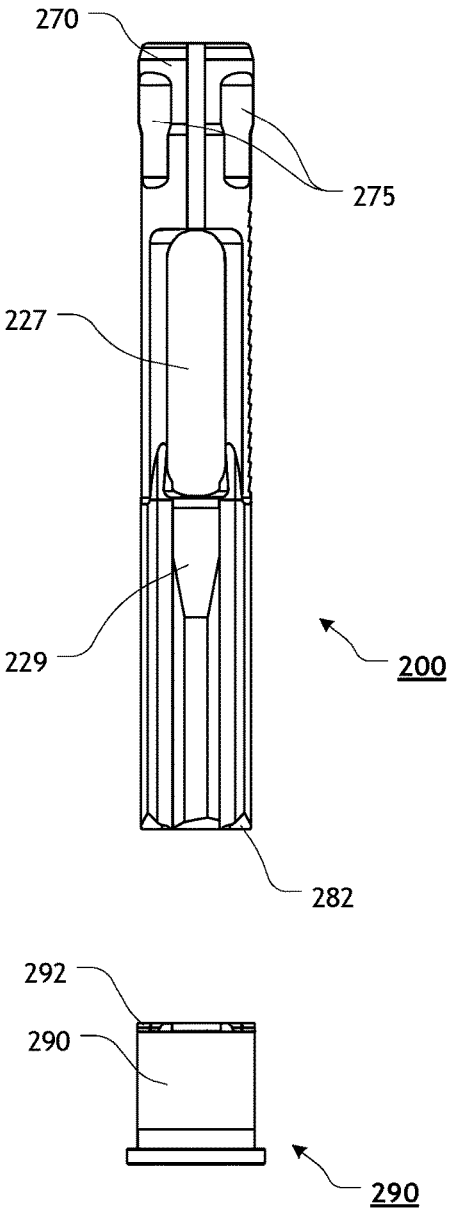
FIG. 14 illustrates a bottom view of an exemplary embodiment of a bolt carrier and barrel extension, as disclosed herein.
Figure 15:
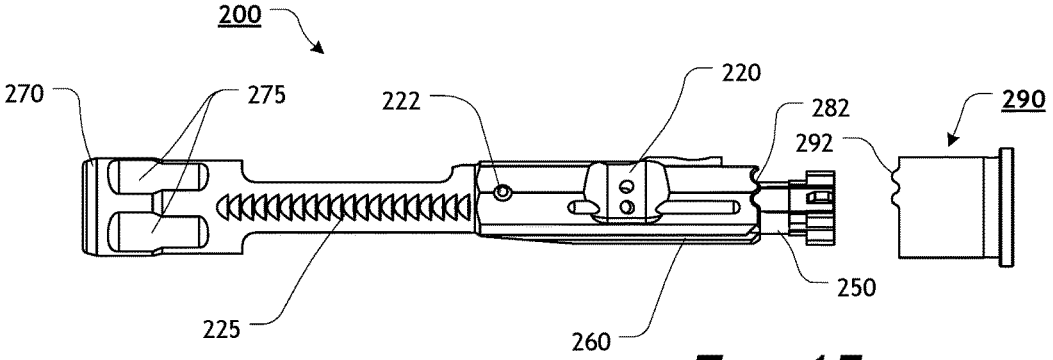
FIG. 15 illustrates a right side view of an exemplary embodiment of a bolt carrier and barrel extension, as disclosed herein.
Figure 16:
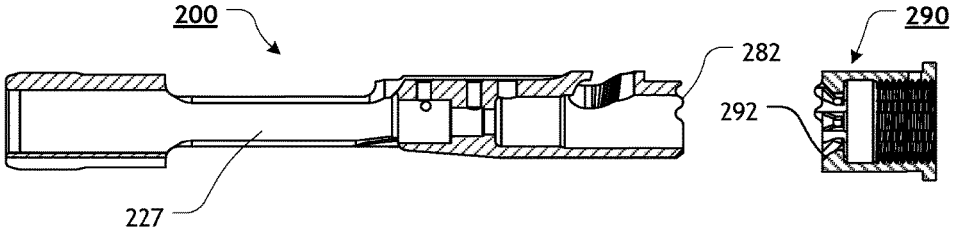
FIG. 16 illustrates a right side cross-sectional view taken along line 16-16 of the bolt carrier of FIG. 13, illustrating an exemplary embodiment of a bolt carrier and barrel extension, as disclosed herein.
Figure 17:
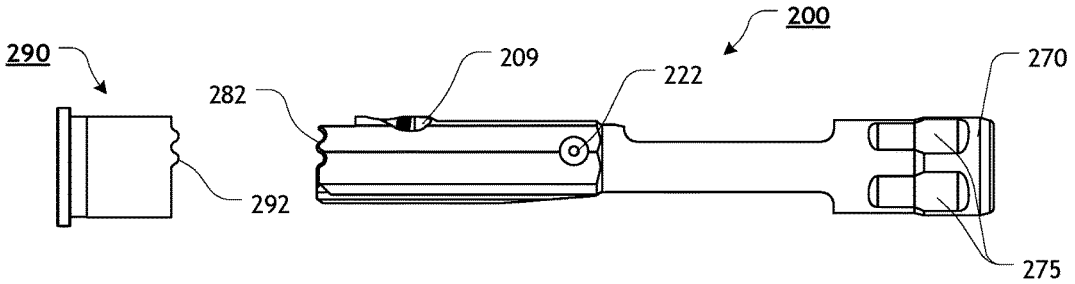
FIG. 17 illustrates a left side view of an exemplary embodiment of a bolt carrier and barrel extension, as disclosed herein.

It should be appreciated that the bolt carrier 100 includes many of the features of the standard bolt carrier 20, as illustrated in FIGS. 1-3. For example, the bolt carrier 100 includes one or more bolt carrier gas key threaded apertures 112 formed so as to allow a bolt carrier gas key, such as, for example, bolt carrier gas key 40, to be attached or coupled atop the bolt carrier 100, such that the key gas aperture 110 is in fluid communication with, for example, the gas aperture 42 of the bolt carrier gas key 40.

A hammer relief 127, having a hammer ramp 129, is formed in at least a portion of the bolt carrier 100. In certain exemplary, nonlimiting embodiments, a plurality of forward assist grooves 125 may optionally be formed along a portion of the bolt carrier 100.

A firing pin retaining pin aperture 122 is formed through a portion of the bolt carrier 100 so as to retain a firing pin retaining pin, such as, for example, a standard firing pin retaining pin 60.

If included, an ejection port door recess 120 allows the bolt carrier 100 to interact with at least a portion of an ejection port cover door to allow the ejection port cover door to be maintained in a closed position when the bolt carrier 100 is in a forward position and automatically opened, when the bolt carrier is moved rearward, from the forward position.

Additionally, the cam pin slot 109 is formed so as to interact with a cam pin, such as, for example, a cam pin 30. Thus, it should be appreciated that the bolt carrier 100 is operable within a firearm, similar to the operation of the standard bolt carrier 20.

It should also be appreciated that the barrel extension 190 includes many of the features of the standard barrel extension. For example, the barrel extension includes an internally threaded aperture that is formed so as to be threadedly attached to the breach or chamber end (or rear) of a barrel. The barrel extension also includes a portion with bolt locking lugs that allow the bolt to lock into. The barrel extension may also include feed ramps, which assist in guiding a round into the barrel chamber.

It should also be appreciated that a more detailed explanation of the standards elements and/or features of a known bolt carrier and/or barrel extension, instructions regarding how to install and use a bolt carrier and/or barrel extension, and certain other items and/or techniques necessary for the implementation and/or operation of the various exemplary embodiments of the presently disclosed bolt carrier 100 and/or barrel extension 190 are not provided herein because such elements are commercially available and/or such background information will be known to one of ordinary skill in the art. Therefore, it is believed that the level of description provided herein is sufficient to enable one of ordinary skill in the art to understand, produce, and utilize the bolt carrier 100 and/or barrel extension 190, as described.

In various exemplary embodiments, a primary or first gas port 151 provides fluid communication between the interior and the exterior of the bolt carrier 100 and, more specifically, between the bolt receiving aperture 105 and/or the firing pin receiving aperture 107 and the exterior of the bolt carrier 100.

The first gas port 151 has an initial portion with a longitudinal axis, $A_{P1}$, which is approximately 45° from the longitudinal axis, $A_L$, of the bolt carrier 100 or the bolt receiving aperture 105 of the bolt carrier 100. In certain exemplary embodiments, the longitudinal axis, $A_{P1}$, of the initial portion of the first gas port 151 may extend approximately 40° to 50° from the longitudinal axis, $A_L$, of the bolt carrier 100 or the bolt receiving aperture 105. In still other exemplary embodiments, the longitudinal axis, $A_{P1}$ of the initial portion of the first gas port 151 may extend approximately 30° to 60° from the longitudinal axis, $A_L$, of the bolt carrier 100 or the bolt receiving aperture 105.

A subsequent portion of the first gas port 151 forms a shroud for the first gas port 151 and extends forward at approximately 10° relative to the longitudinal axis, $A_L$, of the bolt carrier 100 or the bolt receiving aperture 105 of the bolt carrier 100. In various exemplary embodiments, the shroud for the first gas port 151 may extend at approximately 9° to 11° relative to the longitudinal axis, $A_L$, of the bolt carrier 100 or the bolt receiving aperture 105. In still other exemplary embodiments, the shroud for the first gas port 151 may extend at approximately 5° to 15° relative to the longitudinal axis, $A_L$, of the bolt carrier 100 or the bolt receiving aperture 105.

In certain exemplary embodiments, the first gas port 151 extends through the bolt carrier 100 in a main body portion of the bolt carrier 100. Alternatively, the first gas port 151 may extend through the bolt carrier 100 within or proximate the ejection port door recess 120.

The diameter of the first gas port 151 is a design choice based upon the desired amount of expelled gases that are to flow through the first gas port 151

During use, as gasses are expelled into the cavity of the bolt carrier 100, the gasses are vented from the first gas port 151 (and the first gas port 151 shrouded portion) so that the gasses are ported in a forward direction or angle at a point further forward, toward the breech of the upper receiver. As the bolt carrier 100 moves backwards inside the upper receiver, during cycling, the shrouded first gas port 151 causes excess propellant gas to flow forward and substantially parallel with the inside of the upper receiver. This is unlike the gas ports of typical bolt carriers, which expel propellant gases 90° (or perpendicular) to the longitudinal axis, $A_L$, of the bolt carrier 100 or the bolt receiving aperture 105 of the bolt carrier 100 and expel the propellant gases against the inside of the upper receiver, causing increased fouling in all directions.

To further aid in the expulsion of propulsion gases, a gas trough 160 may optionally be formed along at least a portion of the exterior of the bolt carrier 100. In various exemplary embodiments, the gas trough 160 is formed substantially parallel to the first gas port 151. In this manner, as the bolt carrier 100 cycles rearward within the upper receiver of the firearm, excess propellant gases can still be directed forward of the bolt carrier 100 and out of the ejection port, via the gas trough 160.

The overall depth, size, shape, and profile of the shroud and the gas trough 160 are design choices based upon the desired functionality, performance, and/or appearance of the shroud and the gas trough 160.

The second gas port 152 and the third gas port 153 comprise apertures that provide further fluid communication between the interior and the exterior of the bolt carrier 100 and, more specifically, between the bolt receiving aperture 105 and the exterior of the bolt carrier 100. In various exemplary embodiments, the second gas port 152 and the third gas port 153 comprise enlarged apertures, each having a longitudinal axis, $A_{P2}$ and $A_{P3}$, respectively. The diameter of the second gas port 152 and the third gas port 153 is a design choice based upon the desired amount of expelled gases that are to flow through the second gas port 152 and the third gas port 153.

Typically, the longitudinal axis, $A_{P2}$ and $A_{P3}$, of the second gas port 152 and the third gas port 153, respectively, are angled slightly forward. In certain exemplary, nonlimiting embodiments, the longitudinal axis, $A_{P2}$ and $A_{P3}$ are angled at approximately 70° to 75°, relative to the longitudinal axis, $A_L$, of the bolt carrier 100 or the bolt receiving aperture 105 of the bolt carrier 100. In various exemplary embodiments, the longitudinal axis, $A_{P2}$ and $A_{P3}$ may extend at approximately 65° to 80°, relative to the longitudinal axis, $A_L$, of the bolt carrier 100 or the bolt receiving aperture 105 of the bolt carrier 100. In still other exemplary embodiments, the longitudinal axis, $A_{P2}$ and $A_{P3}$ may extend at approximately 60° to 85°, relative to the longitudinal axis, $A_L$, of the bolt carrier 100 or the bolt receiving aperture 105 of the bolt carrier 100.

In various exemplary embodiments, the longitudinal axis of the second gas port 152 $A_{P2}$ is parallel to the longitudinal axis of the third gas port 153 $A_{P3}$. In certain alternate embodiments, the longitudinal axis of the second gas port 152 $A_{P2}$ is not parallel to the longitudinal axis of the third gas port 153 $A_{P3}$. Thus, it should be appreciated that the second gas port 152 may direct propellant gases in substantially the same direction as the third gas port 153 or may direct propellant gases in a slightly different direction.

The second gas port 152 and the first gas port 151 extend substantially laterally, along a central, horizontal axis, $A_H$, of the bolt carrier 100 or the bolt receiving aperture 105 of the bolt carrier 100. It should be appreciated that in certain, alternative embodiments, the second gas port 152 and the first gas port 151 may extend at an angle relative to the central, horizontal axis, $A_H$.

The third gas port 153 extends from the bolt receiving aperture 105 at an angle relative to the central, horizontal axis, $A_H$. In various exemplary embodiments, the third gas port 153 extends from the bolt receiving aperture 105 at an angle of approximately 35° relative to the central, horizontal axis, $A_H$. In this manner, not only is a portion of the propellant gas expelled and directed forward of the bolt carrier 100, but is also expelled and directed upward, relative to the bolt carrier 100.

In various exemplary embodiments, the third gas port 153 may extend from the bolt receiving aperture 105 at an angle of between 30° and 40° relative to the central, horizontal axis, $A_H$. In still other exemplary embodiments, the third gas port 153 may extend from the bolt receiving aperture 105 at an angle of between 25° and 45° relative to the central, horizontal axis, $A_H$.

In certain exemplary, nonlimiting embodiments, the second gas port 152 and the third gas port 153 apertures are enlarged and cut so that they are angled slightly forwards and in a narrower vertical angle. Thus, during the cycling of the bolt carrier 100, a greater amount of propellant gas flows out of the bolt carrier 100 at the time of unlocking and at a tighter angle and more forward. Effectively, the bolt carrier 100 of the present disclosure is able to expel more propellant gases through the ejection port opening of the upper receiver.

Additionally, because of the configuration of the first gas port 151, as propellant gases exit the first gas port 151, the propellant gases are forced across the path of the gases being expelled from the second gas port 152, at least partially disrupting the flow of propellant gasses from the second gas port 152 and further urging the propellant gasses from the second gas port 152 forward of the bolt carrier 100, toward and potentially through the gas trough 160.

As illustrated, the rear portion of the bolt carrier 100 includes a larger diameter boss 170 that extends from the main body portion of the bolt carrier 100. Generally, the outer diameter of the boss 170 is greater than the outer diameter of the main body portion of the bolt carrier 100.

The boss 170 is formed so as to reduce the gap between the outer surface of the boss 170 and the inner surface of the upper receiver and/or inner diameter of the buffer tube of the firearm. Thus, the larger diameter boss 170 assists in holding the bolt carrier 100 at a more consistent angle within the upper receiver. By providing the larger diameter boss 170, the bolt carrier 100 is able to maintain more contact with the interior surfaces of the upper receiver and/or interior surfaces of the buffer tube and, unlike known bolt carriers, will not hang off the bolt during cycling.

Additionally, because the bolt carrier 100 of the present disclosure is able to maintain more contact with the interior surface of the upper receiver and/or buffer tube, the bolt carrier 100 is able to be positioned, or sit, in a more parallel fashion, relative to the inside of the upper receiver. This provides for more consistent bolt positioning within the barrel extension, ultimately increasing the accuracy of the firearm.

In various exemplary embodiments, relief cuts 175 are formed in the rear portion and/or boss 170 portion of the bolt carrier 100 so as to reduce or minimize the amount of surface area that is in contact with the inside of the upper receiver, while still maintaining sufficient contact with the inside of the upper receiver and the buffer tube to maintain the parallel positioning of the bolt carrier 100. Thus, in certain exemplary embodiments, the degree of friction between the boss 170 and the upper receiver and/or buffer tube can be reduced. Additionally, the relief cuts 175 may optionally act to provide debris channels for debris to be moved away from the contact area of the boss 170.

As illustrated in FIGS. 4-10, the front face 182 of the bolt carrier 100 includes one or more surface preparations or features formed at least partially thereon or therein. In certain exemplary, nonlimiting embodiments, as illustrated in FIGS. 4-10, the front face 182 includes one or more angled recesses (or angled projections). In various exemplary embodiments, the angled recesses are formed of "V" or "W" style angled portions, recesses, or cuts. In certain exemplary embodiments, the surfaces of the walls that form the angled recesses are formed at an angle that is greater than 90°, or obtuse. In certain exemplary embodiments, the surfaces of the walls that form the angled recesses are formed at an angle that is less than 90°, or acute. Alternatively, the surfaces of the walls that form the angled recesses are formed at an angle that is 90°, such that the surfaces are perpendicular to one another.

While the walls forming the angled recesses are illustrated as intersecting along a line, to form a substantially "V" or "W" shaped portion or cut, it should be appreciated that the walls forming the angled recesses may be separated or spaced apart from one another by a flat or other portion.

The angled recesses are illustrated as traversing the front face 182 in a substantially horizontal manner. It should be understood that the angled recesses may be formed so as to traverse all or a portion of the front face 182 in a substantially horizontal, vertical, or other manner. Thus, the angled recesses may be formed at any angle or rotational angle relative to the bolt carrier 100.

Similar mating or interlocking surface preparations or features are formed at least partially on or in a rear face 192 of the barrel extension 190. Thus, as illustrated in FIGS. 4-10, the rear face 192 includes one or more angled recesses (or angled projections), which correspond or at least partially correspond with the angled recesses formed in the front face 182 of the bolt carrier 100.

In this manner, at least portions of the front face 182 are able to come into mating contact with at least portions of the rear face 192. Thus, during use, as the front face 182 of the bolt carrier 100 contacts the rear face 192 of the barrel extension 190, the mating or interlocking angled recesses initially assist in guiding the bolt carrier 100 in a desired alignment with the barrel extension 190.

In certain exemplary embodiments, as the front face 182 of the bolt carrier 100 continues to contact the rear face 192 of the barrel extension 190, the mating or interlocking angled recesses assist in maintaining the bolt carrier 100 in a desired alignment with the barrel extension 190.

Based on the size and shape of the mating or interlocking angled recesses, the angled recesses can assist in maintaining the bolt carrier 100 in one or more of a desired rotational alignment, horizontal alignment, and/or vertical alignment relative to the barrel extension 190.

When viewed over the entire front face 182 and/or rear face 192, the angled recesses provide at least a partially non-planar portion to the front face 182 of the bolt carrier 100 and the rear face 192 of the barrel extension 190.

FIGS. 11-17 illustrate certain elements and/or aspects of an exemplary embodiment of the bolt carrier 200 and barrel extension 290, as disclosed herein. As illustrated in FIGS. 11-17, the bolt carrier 200 and barrel extension 290 comprise elements that correspond to and operates similarly to the similarly named and/or numbered elements, as described above with reference to the bolt carrier 100 and barrel extension 190 of FIGS. 4-10.

However, as illustrated in FIGS. 11-17, the front face 282 of the bolt carrier 200 includes one or more surface preparations or features formed at least partially thereon or therein. In certain exemplary, nonlimiting embodiments, as illustrated in FIGS. 11-17, the front face 282 includes one or more curved recesses. In various exemplary embodiments, the curved recesses are formed of one or more "U" shaped curved recesses. In certain exemplary embodiments, the curved recesses are joined to form a sine wave or sine curve along at least a portion of the front face 282. In various exemplary embodiments, the curved recesses form smooth, repetitive recesses along at least a portion of the front face 282. It should be appreciated that the relative height or depth of the curved recesses (similar to the amplitude of a sine wave) as well as the relative distance between peaks and troughs of the curved recesses (similar to the wavelength of a sine wave) may be varied.

While the curved recesses are illustrated as traversing the front face 282 in a substantially horizontal manner. It should be understood that the curved recesses may be formed so as to traverse all or a portion of the front face 282 in a substantially horizontal, vertical, or other manner. Thus, the curved recesses may be formed at any angle or rotational angle relative to the bolt carrier 200.

Similar mating or interlocking surface preparations or features are formed at least partially on or in a rear face 292 of the barrel extension 290. Thus, as illustrated in FIGS. 11-17, the rear face 292 includes one or more curved recesses (or curved projections), which correspond or at least partially correspond with the curved recesses (or curved projections) formed in the front face 282 of the bolt carrier 200.

In this manner, at least portions of the front face 282 are able to come into mating contact with at least portions of the rear face 292. Thus, during use, as the front face 282 of the bolt carrier 200 contacts the rear face 292 of the barrel extension 290, the mating or interlocking curved recesses initially assist in guiding the bolt carrier 200 in a desired alignment with the barrel extension 290.

In certain exemplary embodiments, as the front face 282 of the bolt carrier 200 continues to contact the rear face 292 of the barrel extension 290, the mating or interlocking curved recesses assist in maintaining the bolt carrier 200 in a desired alignment with the barrel extension 290.

Based on the size and shape of the mating or interlocking curved recesses, the curved recesses can assist in maintaining the bolt carrier 200 in one or more of a desired rotational alignment, horizontal alignment, and/or vertical alignment relative to the barrel extension 290.

When viewed over the entire front face 282 and/or rear face 292, the curved recesses provide at least a partially non-planar portion to the front face 282 of the bolt carrier 200 and the rear face 292 of the barrel extension 290.

While the one or more surface preparations or features formed at least partially on or in the front face 182 and/or the front face 282 and/or the rear face 192 and/or the rear face 292 have been shown and described as having angled or recessed surface preparations or features, it should be appreciated that the present disclosure is not so limited. Thus, for example, the mating or interlocking surface preparations or features formed in the portions of the front face of the bolt carrier may comprise any mating or interlocking surface preparations, textures, or features (such as, for example, mating or interlocking stippling, checkering, angled cuts, troughs and valleys, recesses and protrusions, etc.).

It is believed that the level of description provided herein is sufficient to enable one of ordinary skill in the art to understand and practice the present disclosure, as described.

While this disclosure has been described in conjunction with the exemplary embodiments outlined above, the foregoing description of exemplary embodiments of the present disclosure, as set forth above, are intended to be illustrative, not limiting and the fundamental disclosure should not be considered to be necessarily so constrained. It is evident that the disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the disclosure. The upper and lower limits of these smaller ranges may independently be included in the smaller ranges and is also encompassed within the disclosure, subject to any specifically excluded limit in the stated range. Where the stated range includes one or both of the limits, ranges excluding either or both of those included limits are also included in the disclosure.

It is to be understood that the phraseology of terminology employed herein is for the purpose of description and not of limitation. Unless defined otherwise, all technical and scientific terms used herein have the same meaning as commonly understood by one of ordinary skill in the art to which this disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A mating bolt carrier and barrel extension, comprising:

a bolt carrier having a front face that includes one or more surface preparations or features formed at least partially thereon or therein, wherein each of said one or more surface preparations or features is formed so as to traverse said front face of said bolt carrier; and a barrel extension having a rear face that includes one or more surface preparations or features formed at least partially thereon or therein, wherein at least a portion of said one or more surface preparations or features of said barrel extension are capable of mating with said surface preparations or features of said front face of said bolt carrier.

2. The mating bolt carrier and barrel extension of claim 1, wherein said one or more surface preparations or features formed at least partially on or in said front face of said bolt carrier comprise interlocking recesses and projections.

3. The mating bolt carrier and barrel extension of claim 1, wherein said one or more surface preparations or features formed at least partially on or in said front face of said bolt carrier comprise interlocking angled recesses and angled projections.

4. The mating bolt carrier and barrel extension of claim 1, wherein said one or more surface preparations or features formed at least partially on or in said front face of said bolt carrier comprise interlocking curved recesses and curved projections.

5. The mating bolt carrier and barrel extension of claim 1, wherein said one or more surface preparations or features formed at least partially on or in said rear face of said barrel extension traverse said front face of said bolt carrier so as to extend through opposing sides of said front face of said bolt carrier.

6. A mating bolt carrier and barrel extension, comprising:

a bolt carrier extending to a front face and having a bolt receiving aperture formed through at least a portion of said bolt carrier, said front face of said bolt carrier having one or more recesses and projections, wherein each of said one or more recesses and projections traverses said front face of said bolt carrier; and a barrel extension extending from a rear face, said rear face of said barrel extension having one or more recesses and projections, wherein at least a portion of each surface of said one or more recesses and projections of said rear face of said barrel extension is mateable with at least a portion of each surface of said one or more recesses and projections of said front face of said bolt carrier.

7. The mating bolt carrier and barrel extension of claim 6, wherein said recesses and projections of said front face of said bolt carrier are angled recesses and angled projections.

8. The mating bolt carrier and barrel extension of claim 6, wherein at least a portion of each surface of said one or more recesses and projections of said rear face of said barrel extension correspond to and are mateable with at least a portion of each surface of said one or more recesses and projections of said front face of said bolt carrier.

9. The mating bolt carrier and barrel extension of claim 6, wherein at least a portion of each mateable surface of said one or more recesses and projections of said rear face of said barrel extension is parallel to a corresponding, mateable portion of each surface of said one or more recesses and projections of said front face of said bolt carrier.

10. The mating bolt carrier and barrel extension of claim 6, wherein adjacent surfaces that form said recesses and projections are non-planar surfaces.

11. The mating bolt carrier and barrel extension of claim 6, wherein said recesses and projections traverse said front face of said bolt carrier so as to extend through opposing sides of said front face of said bolt carrier.

12. The mating bolt carrier and barrel extension of claim 6, wherein said recesses and projections of said front face of said bolt carrier are curved recesses and curved projections that form one or more substantially "U" shaped recesses and projections in said front face.

13. The mating bolt carrier and barrel extension of claim 6, wherein said recesses and projections traverse at least a portion of said rear face of said barrel extension.

14. The mating bolt carrier and barrel extension of claim 6, wherein said recesses and projections traverse said rear face of said barrel extension.

15. A mating bolt carrier and barrel extension, comprising:

a bolt carrier extending to a front face, said front face of said bolt carrier having one or more recesses and projections, wherein said one or more recesses and projections traverse said front face of said bolt carrier; and a barrel extension extending from a rear face, said rear face of said barrel extension having one or more recesses and projections, wherein at least a portion of each surface of said one or more recesses and projections of said rear face of said barrel extension is mateable with at least a portion of each surface of said one or more recesses and projections of said front face of said bolt carrier.

16. The mating bolt carrier and barrel extension of claim 15, wherein said recesses and projections of said front face of said bolt carrier are angled recesses and angled projections.

17. The mating bolt carrier and barrel extension of claim 15, wherein at least a portion of each mateable surface of said one or more recesses and projections of said rear face of said barrel extension is parallel to a corresponding, mateable portion of each surface of said one or more recesses and projections of said front face of said bolt carrier.

18. The mating bolt carrier and barrel extension of claim 15, wherein adjacent surfaces that form said recesses and projections are formed at corresponding angles relative to one another.

19. The mating bolt carrier and barrel extension of claim 15, wherein adjacent surfaces that form said recesses and projections are formed at mateable angles relative to one another.

20. The mating bolt carrier and barrel extension of claim 15, wherein said recesses and projections of said front face of said bolt carrier are curved recesses and curved projections.

* * * * *